US005226740A

United States Patent [19]

Kodama

[11] Patent Number: 5,226,740

[45] Date of Patent: Jul. 13, 1993

[54] INK RIBBON CASSETTE

[75] Inventor: Hidetoshi Kodama, Tokyo, Japan

[73] Assignee: Seikosha Co., Ltd., Japan

[21] Appl. No.: 759,034

[22] Filed: Sep. 5, 1991

Related U.S. Application Data

[63] Continuation of Ser. No. 474,207, Jan. 31, 1990, abandoned, which is a continuation of Ser. No. 361,828, Jun. 1, 1989, abandoned, which is a continuation of Ser. No. 162,894, Mar. 2, 1988, abandoned.

[30] Foreign Application Priority Data

Mar. 2, 1987 [JP] Japan ..... 62-30109[U]

[51] Int. Cl.[5] ..... B41J 32/02

[52] U.S. Cl. ..... 400/196.1; 400/194

[58] Field of Search ..... 400/196, 196.1, 207, 400/208, 234, 208.1, 248, 249, 194, 195; 101/93.04

[56] References Cited

U.S. PATENT DOCUMENTS

| | | | |
|---|---|---|---|
| 4,451,165 | 5/1984 | Fudatsuji et al. | 400/196.1 |
| 4,645,364 | 2/1987 | Ohsaki | 400/208 X |
| 4,715,735 | 12/1987 | Kuzuya et al. | 400/208 X |
| 4,783,184 | 11/1988 | Santillo et al. | 400/208 X |

FOREIGN PATENT DOCUMENTS

| | | | |
|---|---|---|---|
| 175010 | 3/1986 | European Pat. Off. | 400/208 |
| 2108742 | 9/1972 | Fed. Rep. of Germany | 400/196.1 |
| 191182 | 11/1983 | Japan | 400/196.1 |

*Primary Examiner*—David A. Wiecking

*Attorney, Agent, or Firm*—Bruce L. Adams; Van C. Wilks

[57] ABSTRACT

An ink ribbon cassette in which at least one of both side walls of a chamber in which an ink ribbon is accommodated is inclined as viewed in plan view relative to a ribbon portion exposed from openings formed in corresponding two arms, one extending from each end of the chamber.

17 Claims, 2 Drawing Sheets

INK RIBBON CASSETTE

This is a continuation of Ser. No. 474,207 filed Jan. 31, 1990 which in turn is a continuation of Ser. No. 361,828 filed Jun. 1, 1989 which in turn is a continuation of Ser. No. 162,894 filed Mar. 2, 1988 all now abandoned.

BACKGROUND OF THE INVENTION

This invention relates to an ink ribbon cassette used in a printer, etc.

Generally, an ink ribbon cassette used in a printer, etc., includes a chamber which accommodates an endless ink ribbon and a pair of arms, one extending from each end of the chamber. Most of the ink ribbon is accommodated in a zigzag folded state with a run of the ribbon being exposed through corresponding openings provided at the ends of the arms The inner wall of the ribbon accommodating chamber is formed horizontal relative to the exposed ink ribbon portion as viewed in a plan view.

In the conventional ribbon cassette mounted in a printer, when an accommodated ink ribbon is very long or highly impregnated with ink, the area of the ink ribbon contacting the inner surface of the ribbon chamber becomes larger, increasing the frictional resistance or the ink ribbon is likely to adhere to the inner surface of the ribbon chamber due to adhesiveness of the ink, so that the slidability of the ribbon is reduced. Therefore, the movement of the ribbon is likely to become bad and a large force is required to feed the ribbon to thereby require larger torque for driving the ribbon.

It is an object of this invention to improve the slidability of the ink ribbon and move the ribbon smoothly with low drive torque.

SUMMARY OF THE INVENTION

According to this invention, there is provided an ink ribbon cassette in which at least one of both side walls of a chamber in which an ink ribbon is accommodated is inclined as viewed in plan view relative to a ribbon portion exposed from openings formed in two arms, one extending from each end of the chamber.

DETAILED DESCRIPTION

One embodiment of this invention will now be described with reference to the drawings.

Figure 1:
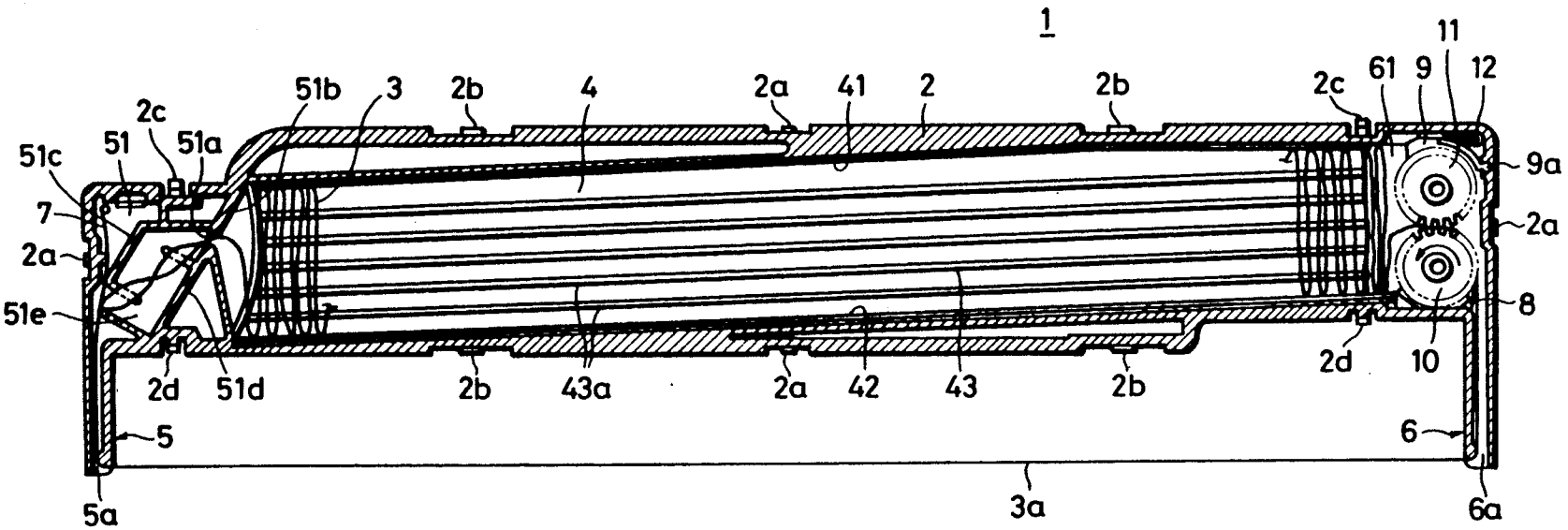
FIG. 1 is a plan view of one embodiment of this invention, showing a part thereof in cross section view.

As shown in FIG. 1, the case 2 of an ink ribbon cassette 1 has a chamber which accommodates an ink ribbon 3 in a folded zigzag formation and a pair of arms 5 and 6, one extending integrally from each end of the chamber 4. Arms 5 and 6 have corresponding openings 5*a* and 6*a*, respectively, at their ends with a run 3*a* of the ribbon 3 being exposed between the arms. Provided at the bases of arms 5 and 6 are a ribbon feed unit 51 which feeds out the ribbon 3 and a ribbon drawing-in unit 61 which draws in the ribbon, respectively. The ribbon feed unit 51 has a wall 51*b* in which a slit 51*a* is provided through which the ribbon 3 is passable, and a ribbon reversing section 51*e* enclosed by walls 51*c* and 51*d*. A ribbon hold spring 7 pushes the ribbon 3 resiliently against the end of wall 51*d*. The ribbon drawing-in unit 61 is supported rotatably in a through hole (not shown) provided in the bottom and a drive roller 10 and a follower roller 11 fitted rotatably are disposed on separators 8 and 9, respectively. Drive roller 10 is driven via a ribbon drive mechanism (not shown) provided in the printer on which the ribbon cassette 1 is mounted. Separator 9 is engaged swingably in an inner end surface of the case 2 via a separator protrusion 9*a* and causes follower roller 11 to be pushed against and meshed with drive roller 10 via a push spring 12.

Figure 2:
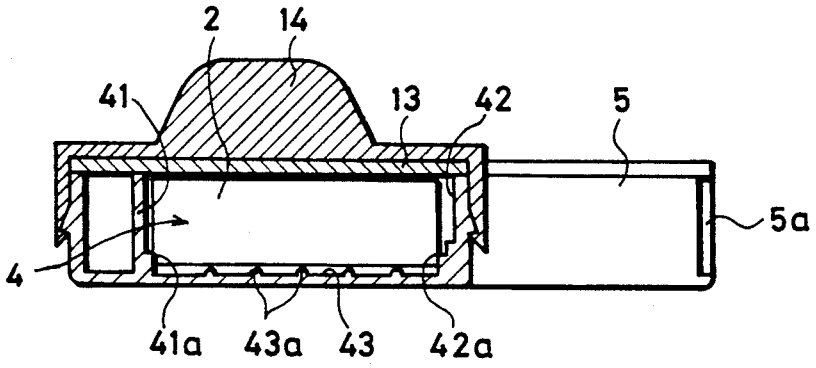
FIG. 2 is an enlarged cross section view of the essential portion of the embodiment as viewed from the side.

Rear and front walls 41 and 42 of the chamber 4 are sloped or inclined forwardly (downwardly in FIG. 1) as viewed in top plan view relative to the ink ribbon portion 3*a* exposed between arms 5 and 6 from the ribbon drawing-in side to the ribbon feeding side. The side walls 41 and 42 have inwardly protruding steps 41*a* and 42*a*, respectively, as shown in FIG. 2. The step 42*a* on the front side wall 42 is of two-step type, the lower step of which extends inwardly. A plurality of strips 43*a* are formed on the bottom 43 of the chamber 4 so as to be parallel to side walls 41 and 42.

Figure 3:
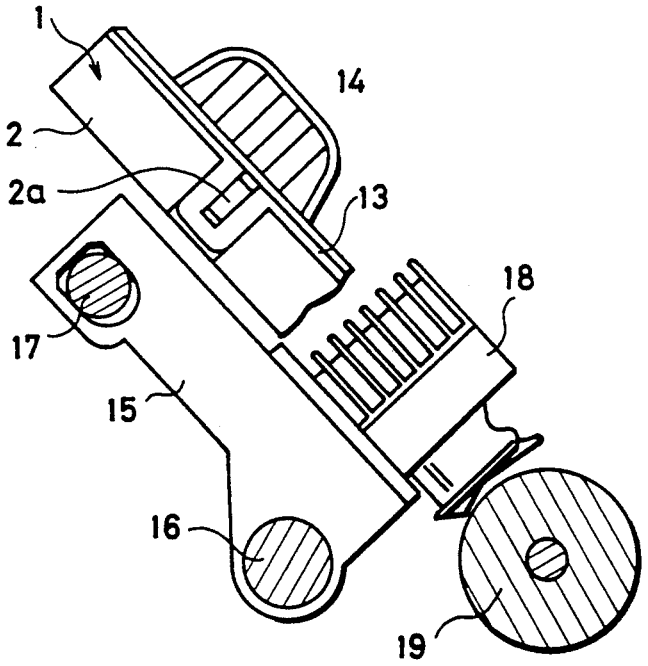
FIG. 3 is a cross section view of the essential portion of the embodiment viewed from the side, showing one example in which a ribbon cassette is mounted.

The protrusions 2*a* and 2*b* formed on the outer peripheral surface of case 2 are engaged with a cap 13 and a handle 14 (both are shown in FIGS. 2 and 3). Pawls 2*c* and 2*d* provided at each end of the case are engaged with ribbon cassette holding means (not shown) when the ribbon cassette 1 is mounted on the printer or the like.

FIG. 3 shows one example in which the ribbon cassette 1 is mounted on the printer. In the printer, a feed carriage 15 is supported slidably by guide shafts 16 and 17 with its forward portion being inclined downwardly as viewed from the side. A printing head 18 mounted on the feed carriage 15 opposes a platen 19 with an inclination corresponding to that of the carriage 15. The ribbon cassette 1 is mounted in a predetermined inclined state on the printer by means of a ribbon cassette holding means (not shown) such that its forward portion is inclined downwardly as viewed from the side, corresponding to the inclination of carriage 15 and printing head 18.

The ink ribbon 3 accommodated in the ribbon cassette chamber 4 is fed out from arm opening 5*a* by rotating the drive roller 10 in the direction of the arrow in FIG. 1 and drawn in through arm opening 6*a*. The ink ribbon 3 is accommodated in the chamber 4 and folded in a zigzag manner moves from the drawing-in unit 61 toward the ribbon feed unit 51 while contacting the strips 43*a* formed on the bottom 43 and the steps 41*a* and 42*a* formed on the side walls 41 and 42, respectively. If the ribbon cassette is mounted with its forward portion being inclined downwardly as viewed from the side as shown in FIG. 3, the side walls 41 and 42 of the chamber 4 are inclined downwardly along the direction of ribbon movement relative to the exposed ink ribbon portion as viewed in plan view, so that the ribbon filled in the chamber 4 can move smoothly toward the ribbon feed unit. As the ink ribbon 3 is advanced lengthwise, the folds of the ribbon travel downwardly along the downward incline of the sloped front side wall 42, as shown in FIG. 1. Therefore, it is easy to slide the ribbon 3 from the ribbon drawing-in unit 61 to the ribbon feed unit 51, and the ribbon can be moved smoothly and stably with lower drive torque.

The particular embodiment shows that the printing head 18 is disposed such that its forward portion is inclined downwardly relative to the platen 19. Therefore, the ribbon cassette is inclined downwardly so that its forward portion is lowered relative to its rearward portion as viewed from the side, corresponding to the inclination of the printing head 18. Therefore, both side walls 41 and 42 are inclined toward the printing head 18 relative to the exposed ink ribbon portion 3*a* from the ribbon drawing-in side to the ribbon feed side as viewed in plan view. Of course, it goes without saying that only the side 42 on the side of the printing head 18 may be inclined, with the front sidewall 42 at a lower level than the rear sidewall 41 as depicted in FIG. 3.

In contrast, if the printing head 18 is disposed such that its forward portion is inclined upwardly relative to platen 19, the forward portion of ribbon cassette 1 is inclined upwardly corresponding to the inclination of the printing head 18 as viewed from side, so that both side walls 41 and 42 of the chamber 4 may be inclined toward the side opposite the printing head 18 as viewed in plan view relative to the exposed ink ribbon portion 3*a* from the ribbon drawing-in side to the ribbon feed side, in which case the rear sidewall 41 would be at a lower level than the front sidewall 42. Of course, only the side wall 41 on the side opposite printing head 18 may be inclined.

As described above in detail, according to this invention, the front and rear side walls of the chamber which accommodates the ink ribbon are inclined as viewed in plan view relative to the exposed ink ribbon portion, so that the ink ribbon cassette is mounted inclined as viewed from the side, the slidability of the ink ribbon is improved, and the ribbon is moved smoothly and stably with lower drive torque.

What is claimed is:

1. An ink ribbon cassette for use with a printer having a reciprocatable print head and a platen opposed from the print head, the ink ribbon cassette being mountable on the printer in an inclined state relative to the horizontal plane in the side view, the ink ribbon cassette comprising: an ink ribbon chamber defined by top and bottom walls interconnected by two opposed end sidewalls and opposed front and rear sidewalls, two arms extending frontwardly at opposite ends, respectively, of the chamber and having openings therein, an endless ink ribbon disposed in the chamber in a zig-zag formation so that the ink ribbon defines a plurality of folded edges alternately disposed along the front and rear sidewalls of the chamber, the ink ribbon being disposed in the chamber to undergo lengthwise movement and extending through the arm openings to expose a part of the ribbon between the arms for printing by the print head, and drivable feed means disposed at one end of the chamber and operative when driven for feeding the ribbon in the lengthwise direction thereof, wherein either the front sidewall or the rear sidewall is positioned at a lower level than the other, and both the lower-level sidewall and the bottom wall receive the weight of the ink ribbon, and the lower-level sidewall slidably supports the folded edges of the ink ribbon disposed thereon and has a downward slope in the direction of the movement of the ink ribbon in the chamber, from one end sidewall to the other end sidewall the inclination of the downward slope being effective to reduce the friction force between the ribbon and the chamber caused by the weight of the ink ribbon.

2. An ink ribbon cassette according to claim 1; wherein at least one of the front and rear sidewalls has an inwardly protruding step which slidably contacts the ink ribbon during movement thereof in the chamber.

3. An ink ribbon cassette according to claim 2; wherein the bottom wall has a plurality of lengthwise extending projections protruding upwardly therefrom for slidably supporting the ink ribbon.

4. An ink ribbon cassette according to claim 1; wherein the bottom wall has a plurality of lengthwise extending projections protruding upwardly therefrom for slidably supporting the ink ribbon.

5. An ink ribbon cassette according to claim 1; wherein the lower-level sidewall comprises the front sidewall.

6. An ink ribbon cassette according to claim 1; wherein the lower-level sidewall comprises the rear sidewall.

7. An ink ribbon cassette according to claim 1; wherein both of the front and rear sidewalls have a downward slope in the direction of movement of the ink ribbon in the chamber.

8. An ink ribbon cassette for use with a printer having a reciprocatable print head and a platen opposed to the print head, the ink ribbon cassette being mountable in use on the printer in a predetermined inclined state relative to the horizontal and comprising: an ink ribbon chamber defined by opposed top and bottom walls interconnected by two opposed end sidewalls and opposed front and rear sidewalls, two arms extending frontwardly at opposite ends, respectively, of the chamber and having openings therein, an endless ink ribbon disposed in the chamber in a folded formation to undergo lengthwise movement and extending through the arm openings to expose a run of the ink ribbon between the arms for printing by the print head, means for effecting lengthwise advancement of the ink ribbon accompanied by movement of the folds of ink ribbon from one end to the other end of the chamber, and means for causing the folds of ink ribbon to travel downwardly along a downward incline during movement thereof from the one end to the other end of the chamber, said means being separate from the inclination of the cassette when mounted in a predetermined inclined state relative to the horizontal.

9. An ink ribbon cassette according to claim 8; wherein the means for causing the folds of ink ribbon to travel downwardly along a downward incline comprises at least one of the front and rear sidewalls having a downward inclination in the direction of movement of the ink ribbon folds from the one end to the other end of the chamber.

10. An ink ribbon cassette according to claim 9; wherein one of the front and rear sidewalls is disposed at a lower level than the other thereof when the ink ribbon cassette is mounted in the predetermined inclined state so that the weight of the ink ribbon is supported by the lower-level sidewall and the bottom wall.

11. An ink ribbon cassette according to claim 10; wherein the lower-level sidewall comprises the front sidewall.

12. An ink ribbon cassette according to claim 10; wherein the lower-level sidewall comprises the rear sidewall.

13. An ink ribbon cassette according to claim 10; wherein the bottom wall has a plurality of lengthwise extending projections protruding upwardly therefrom for slidably supporting the ink ribbon.

14. An ink ribbon cassette according to claim 8; wherein the means for causing the folds of ink ribbon to travel downwardly along a downward incline comprises one of the front and rear sidewalls being disposed at a lower level than the other thereof when the ink ribbon cassette is mounted in the predetermined inclined state so that the weight of the ink ribbon is supported by the lower-level sidewall and the bottom wall.

15. An ink ribbon cassette according to claim 14; wherein the lower-level sidewall comprises the front sidewall.

16. An ink ribbon cassette according to claim 14; wherein the lower-level sidewall comprises the rear sidewall.

17. An ink ribbon cassette according to claim 14; wherein the bottom wall has a plurality of lengthwise extending projections protruding upwardly therefrom for slidably supporting the ink ribbon.

* * * * *